US005090895A

United States Patent [19]

Jensen et al.

[11] Patent Number: 5,090,895

[45] Date of Patent: Feb. 25, 1992

[54] DEVICE FOR PREVENTING OIL FROM DRIPPING OUT OF THE BURNER NOZZLE OF AN OIL-FIRED HEATING SYSTEM

[75] Inventors: Per F. Jensen, Nordborg; Ingvard M. Madsen, Sonderborg; Leif B. Bonnerup, Nordborg, all of Denmark

[73] Assignee: Danfoxx A/S, Nordborg, Denmark

[21] Appl. No.: 682,368

[22] Filed: Apr. 9, 1991

[30] Foreign Application Priority Data

Jun. 24, 1990 [DE] Fed. Rep. of Germany ..... 4020005

[51] Int. Cl.[5] ..... F23D 11/44

[52] U.S. Cl. ..... 431/208; 431/11; 239/135; 137/341; 392/397; 392/473; 392/480

[58] Field of Search ..... 431/208, 207, 258, 11, 431/209, 135, 136; 392/397, 473, 480, 479; 137/341; 239/135

[56] References Cited

U.S. PATENT DOCUMENTS

| | | | |
|---|---|---|---|
| 1,899,396 | 2/1933 | Ray | 431/11 |
| 2,306,831 | 12/1942 | Proctor | 431/208 |
| 4,354,822 | 10/1982 | Madsen et al. | 431/208 |
| 4,562,336 | 12/1985 | Heimler | 431/208 |

*Primary Examiner*—James C. Yeung

*Attorney, Agent, or Firm*—Wayne B. Easton; Clayton R. Johnson

[57] ABSTRACT

For reducing the unwanted escape (dripping) of oil from a burner nozzle, nozzle holder, oil warmer apparatus is provided to continuously regulate the oil temperature during operation of a oil fired heating system to maintain a nearly constant oil volume in the nozzle holder, oil warmer unit. The apparatus includes a pair of oil pipes that are encapsulated and connected between the nozzle and pump connections, there being a pair of heating elements that are also encapsulated for heating the oil pipes. The first heating element is permanently energized during the operation of the heating system while the second heating element is energized only when oil is being feed to the burner nozzle.

5 Claims, 2 Drawing Sheets

Figure 1:
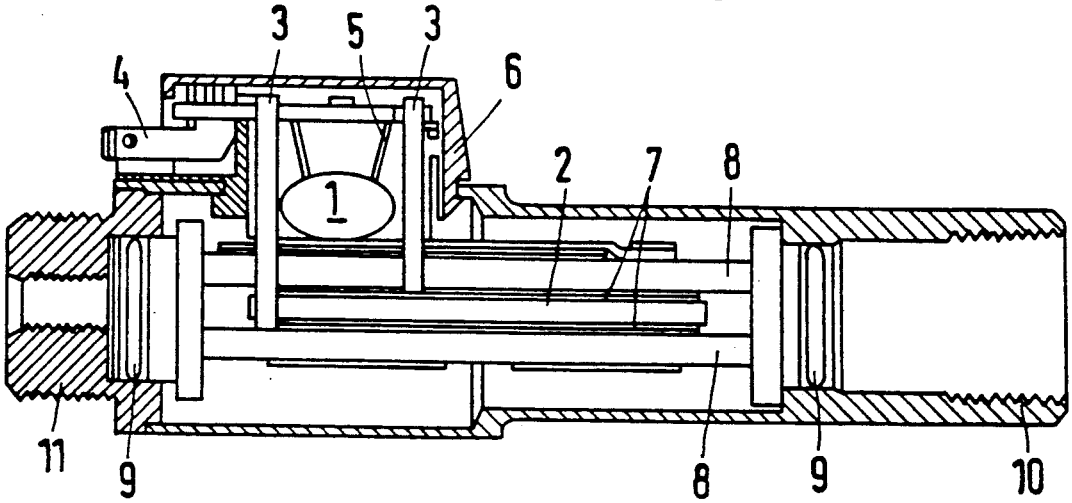

DEVICE FOR PREVENTING OIL FROM DRIPPING OUT OF THE BURNER NOZZLE OF AN OIL-FIRED HEATING SYSTEM

The invention relates to a device for preventing oil from dripping out of the burner nozzle of an oil-fired heating system, with a nozzle-holder/oil-warmer unit which comprises at least one electrical heating element for maintaining the oil temperature.

In a known device of this kind (DE-PS 28 21 207) the nozzle-holder contains an oil pre-warmer, so that the oil pre-warmer is arranged comparatively close to the burner. When the oil pump is switched on, because of the pre-warming the oil has already been pre-warmed virtually as far as the exit opening of the burner nozzle. Moreover, the volume of oil to be pre-warmed is comparatively small, so that the change in volume brought about by the warming is likewise correspondingly small and dripping of oil before ignition of the burner is by and large avoided, just as it is by virtue of a subsequent warming when the burner is turned off. Nevertheless, dripping of the oil and the incomplete combustion associated therewith, as well as coking of the nozzle exit opening and the combustion chamber, is not completely avoided.

For that reason it has already been proposed to arrange a valve that is blocked during the pre-warming time between the pre-warmer and the burner nozzle (DE-PS 38 14 530). To avoid the pressure in front of the valve becoming too high during the pre-warming, a return line with a non-return valve is provided in front of this valve, but this represents additional expense.

Solutions to that problem have therefore become known in which the oil is sucked out of the burner feed line when the burner is turned off (German Patent Specifications 31 03 684, 36 34 345 and 33 03 915). These solutions are, firstly, likewise expensive. Secondly, when the burner is switched on again the oil feed line may contain air which is also warmed by the oil pre-warmer so that oil still drips or spurts out of the burner nozzle.

The invention is based on the problem of providing a device of the kind mentioned in the preamble, which reduces escape of oil from the burner nozzle in a more simple manner.

According to the invention, this problem is solved in that the heating element is arranged to be operated so that the oil temperature is continuously regulated during operation of the oil-fired heating system so that the oil volume in the nozzle-holder/oil-warmer unit largely remains constant.

With that solution, not only is the oil consequently warmed just before switching on and during operation of the burner, but also during pauses in the operation of the burner, in which the boiler temperature controlled by the conventional two-state control unit has exceeded the specified value. Since the oil temperature remains virtually unchanged because of the temperature control, apart from the initial starting up of the heating system or after renewed starting up of the heating system after a relatively long pause in operation, the oil accordingly also does not expand so far that it exceeds a predetermined value, by which means before-dripping or after-dripping of the burner nozzle is substantially avoided. During normal operation, the prewarming time to be maintained before the oil feed is switched on, that is to say, before the oil pump is switched on, until the burner ignites, is substantially shortened. In principle, it can be dispensed with altogether. The burner can therefore briefly be re-ignited after the boiler temperature has fallen below the specified value.

Since no cold oil is supplied to the burner during pauses in operation, in the interests of saving energy, provision may be made for the heat output imparted to the oil during pauses in operation of the burner to be less than when the burner is in operation.

Preferably, in parallel with the first heating element there is connected a series circuit comprising a switch for the boiler temperature control unit and a second heating element for controlling the oil temperature arranged in the nozzle-holder/oil-warmer unit, and the switch is closed only during supply of oil to the burner. In this manner, it is possible for the output of the first heating element to be comparatively low, such as that required for maintaining the oil temperature during pauses in operation of the burner when oil intake is interrupted, since it is only during intake of the oil, especially in winter, when the oil is fed from an oil tank outside the house, that a higher heat output for warming the oil is required. During the oil intake, the second heating element therefore takes over the additional heat output that is required. The energy consumption for maintaining the oil temperature can therefore be kept to a minimum even when the oil is kept permanently warm.

Preferably, provision is also made for the nominal rating of the first heating element to be less than 5 watts.

It is then favourable for the or each heating element to be in the form of a PTC-resistor, and for the first heating element to be permanently switched on during operation of the oil-fired heating system. In that embodiment, a separate control arrangement for the or each heating element is not necessary since a PTC-resistor automatically ensures that the temperature is kept constant.

When two heating elements are provided, the two heating elements can be arranged as extensions of each other. That allows the heating elements to be compactly assembled and installed in a space-saving manner in the oil space of the nozzle-holder/oil-warmer unit.

In addition, the two heating elements can be arranged between two oil feed pipes of metal so that they are in thermal contact with these but are electrically isolated from them, and can be connected with a common electrical conductor to the power supply. This produces a simple compact construction of the device with effective heat transfer between the heating elements and the oil feed pipes.

Figure 2:
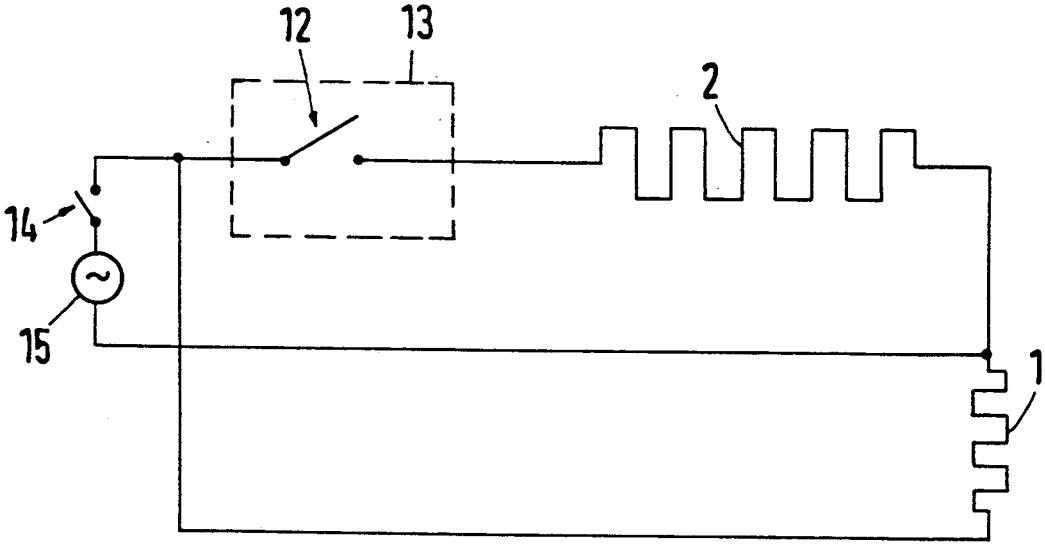
Figure 3:
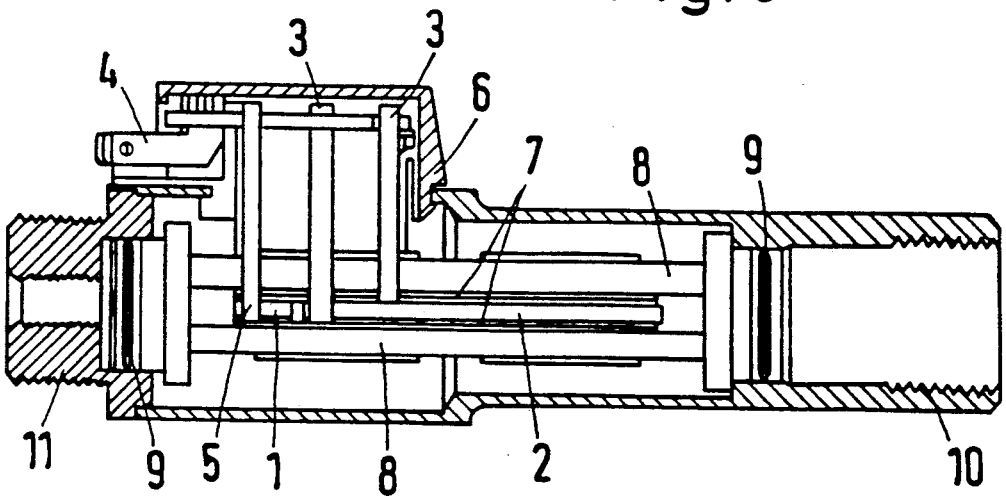
Figure 4:
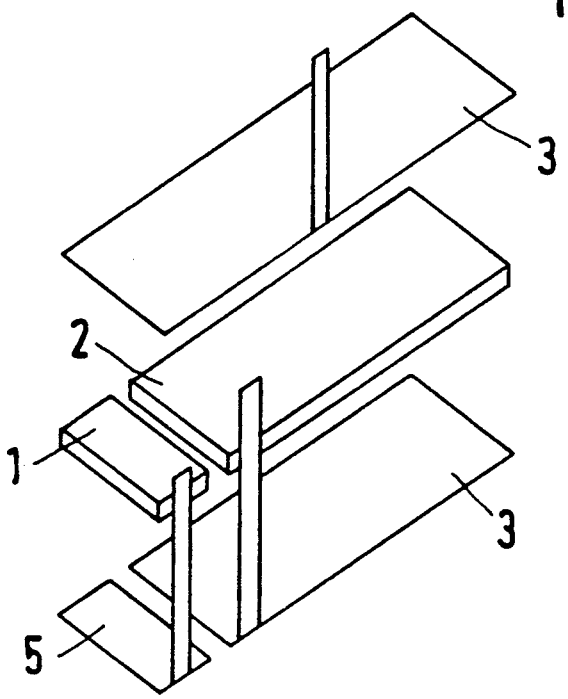

The invention and its developments are described in detail hereinafter with reference to the drawing of preferred embodiments, in which FIG. 1 shows a diagrammatic view of a device according to the invention, partly in section, FIG. 2 shows an electrical switching arrangement with two heating elements of the device according to the invention, FIG. 3 shows a second embodiment of a device according to the invention, and FIG. 4 shows an exploded view of the heating element arrangement shown in FIG. 3 with the associated electrical conductors for the power supply.

The device shown in FIG. 1 is a nozzle-holder/oil-warmer unit for a conventional oil-fired heating system. It contains a first electrical heating element 1 in the form of a ceramic PTC-resistor, which is permanently switched on during the operation of the heating system, a second electrical heating element 2 in the form of a PTC-resistor, which is switched on only as oil is being fed to the burner nozzle, electrical conductors 3 for the power supply to the heating element 2, electrical terminals 4 for the nozzle-holder/oil-warmer unit, an electrical supply conductor of the heating element 1, an encapsulating cover 6 of the nozzle-holder/oil-warmer unit, an insulating foil 7 which insulates the heating element 2 electrically from two oil feed pipes 8 of metal, O-rings 9 for sealing, a nozzle connection 10 and a connection 11 for the oil pump.

According to FIG. 2, connected in parallel with the first heating element 1 is a series circuit comprising a switch 12 of a boiler temperature control unit 13, the remaining switches and parts of which are not shown, and the second heating element 2, which likewise serves to keep the oil temperature constant. The parallel circuit is connected to the a.c. system 15 by an operating switch 14.

As is apparent from FIG. 2, when the oil-fired heating system is switched on by closing the operating switch 14, the heating element 1 is switched on permanently. The heating element 1, which is in thermal contact with the oil feed pipes 8, warms the oil in the pipes 8 and maintains it at a constant temperature. When the boiler temperature control unit 13 establishes that the boiler temperature is too low, by way of switches, not illustrated, the oil pump and an air-supply fan are switched on. At the same time, the second heating element 2 is switched on by closing the switch 12. The permanently switched on first heating element 1 can therefore be designed for a comparatively low heat output of less than 5 watts. The additional heating line required when cold oil is being fed in is then supplied by the second heating element, which likewise ensures that the oil temperature is kept constant; also, however, the second heating element is switched off whenever the oil feed is interrupted and the burner turned off when the boiler temperature exceeds the set specified value. Overall, it is therefore possible to manage with a relatively low heat output for keeping the oil warm; nevertheless, the oil keeps the desired temperature virtually constantly, so that before or after-dripping of the nozzle for want of greater thermal expansion of the oil is substantially avoided. As soon as the boiler temperature drops below the specified value, the burner can be switched on without the relatively long waiting time that was previously required for prewarming. At most, a negligible waiting time for a pre-aeration by the fan would be required. The boiler temperature control unit 13 is present in conventional oil-fired heating systems, and normally also an additional reserve-switch, which can then be used as switch 12. The device illustrated can therefore also be incorporated in oil-fired heating systems that have already been installed, without a complicated modification being required.

In the embodiment according to FIG. 3, the permanently switched on heating element 1 is also arranged between the two oil feed pipes 8. The two heating elements 1 and 2 are in this case assembled as extensions of each other, and are arranged between the oil feed pipes 8 so that they are in thermal contact with these but are electrically insulated from them, and are connected with a common electrical conductor 3, shown in FIG. 3 at the top, to the power supply. This produces a substantially optimum heat transfer even between the heating element 1 and the oil feed pipes 8.

In an exploded view, FIG. 4 shows the arrangement of the electrical heating elements 1 and 2 and also the associated electrical conductors 3 and 5 for the power supply. The insulating foils 7, not illustrated in FIG. 4, are arranged on the outsides of the large-area parts of the electrical conductors 3 and lying adjacent the heating elements 1 and 2, in order to avoid a short circuit between the conductors 3 and 5 by way of the oil feed pipes 8.

We claim:

1. Apparatus for preventing oil dripping out of a burner nozzle of an oil-fired heating system, comprising a nozzle holder, an oil warmer unit having an encapsulating member, the encapsulating member having a nozzle connection portion and an oil connection portion, a first oil feed pipe within the encapsulating member for fluidly connecting the connection portions to one another, a second oil feed pipe fluidly connecting the connection portions to one another, each feed pipe being made of metal, and a first heating element within the encapsulating member for heating oil within the first feed pipe and operable means for powering the heating element to continuously regulate the oil temperature during operation of the oil fired heating system to maintain the volume of oil in the warmer unit nearly constant, the operable means including a second heating element in the encapsulating member, the two heating elements being located between the two feed pipes in thermal contact therewith, and the oil warmer unit including means for electrically insulating the heating elements from the feed pipes.

2. Apparatus according to claim 1 wherein the operable means includes a series circuit connected in parallel with the first heating element, the series circuit including a a boiler temperature control unit having a switch in series with the second heating element for being closed only during the supply of oil to flow through the nozzle connection.

3. Apparatus according to claim 1, wherein the first heating element is of a nominal rating of less and 5 watts.

4. Apparatus according to claim 1, wherein at least one of the heating elements is a PTC resistor and that the operable means includes an operable switch connected in series with the first heating element that is permanently switched on during operation of the oil fired system.

5. Apparatus according to claim 1, wherein the first and second heating elements are assembled as extensions of each other.

* * * * *